US005489097A

United States Patent [19]

Simmons

[11] Patent Number: 5,489,097

[45] Date of Patent: Feb. 6, 1996

[54] GOLF CLUB HEAD WITH WEIGHTS

[75] Inventor: Samuel P. Simmons, Grass Valley, Calif.

[73] Assignee: Alien Sport, Inc., Mountain View, Calif.

[21] Appl. No.: 349,534

[22] Filed: Dec. 5, 1994

[51] Int. Cl.[6] ..... A63B 53/04; A63B 53/08; A63B 69/36

[52] U.S. Cl. ..... 273/170; 273/171; 273/167 F; 273/80 R; 273/173

[58] Field of Search ..... 273/167 R, 167 F, 273/169, 170, 171, 172, 173, 162 R, 77 R, 164.1, 80 R, 81 R, 187.4, 186.2, 162 B

[56] References Cited

U.S. PATENT DOCUMENTS

| | | | |
|---|---|---|---|
| 1,167,106 | 1/1916 | Palmer . | |
| 1,518,316 | 12/1924 | Ellingham | 273/171 |
| 1,561,595 | 11/1925 | Davis . | |
| 1,568,888 | 1/1926 | Dunn . | |
| 2,432,450 | 12/1947 | Sears . | |
| 2,976,046 | 3/1961 | McCullough | 273/162 B |
| 2,998,254 | 8/1961 | Rains | 273/171 |
| 3,037,775 | 6/1962 | Busch | 273/171 |
| 3,374,027 | 3/1968 | Jacobs | 273/169 |
| 3,516,673 | 6/1970 | Estes . | |
| 3,516,674 | 6/1970 | Scarborough | 273/171 |
| 3,897,066 | 7/1975 | Belmont | 273/171 |
| 3,941,390 | 3/1976 | Hussey | 273/171 |
| 3,995,865 | 12/1976 | Cochran | 273/167 F |
| 4,008,896 | 2/1977 | Gordos | 273/171 |
| 4,139,196 | 2/1979 | Riley . | |
| 4,655,459 | 4/1987 | Antonious | 273/171 |
| 4,895,371 | 1/1990 | Bushner | 273/171 |
| 5,004,237 | 4/1991 | Antonious | 273/169 |
| 5,082,279 | 1/1992 | Hull et al. . | |
| 5,244,210 | 9/1993 | Au | 273/171 |
| 5,316,300 | 5/1994 | Simmons . | |

*Primary Examiner*—Sebastiano Passaniti
*Attorney, Agent, or Firm*—Jack M. Wiseman

[57] ABSTRACT

A golf club head having a body. Disposed in the body in the toe to heel direction adjacent the club face is a weight. The body also contains spaced, parallel solid weights that extend from the rear wall of the body toward the club face. The parallel, solid weights are at right angles to the tubular weight and extend adjacent to the tubular weight. One solid weight is located at the heel of the body and another solid weight is located at the toe of the body. Through this arrangement, the club head has face balancing to reduce the incidence of gyrations and vibrations. Also, the club head provides a soft touch to the golfer upon contact between the club head and the golf ball.

12 Claims, 7 Drawing Sheets

GOLF CLUB HEAD WITH WEIGHTS

BACKGROUND OF THE INVENTION

The present invention relates in general to golf clubs, and, more particularly, to a golf club having a golf club head with weights.

In order to improve the putting skills of a golfer, the club head of the putter should have face balancing to reduce the incidence of gyrations and vibrations, as well as reduce the torque and turning moment of the club head at the time of impact between the club head and the golf ball. To further improve the putting skills of a golfer, the club head of the putter should have a soft touch for accurately hitting the golf ball.

In the patent to Palmer, U.S. Pat. No. 1,167,106, issued on Jan. 4, 1916, for Golf Club, there is disclosed a golf club head made of a hollow cast metal. An opening surrounded by a threaded wall is formed in the thickened portion of the club head in which is inserted threaded plugs of varying weight to adapt the weight of the golf club to the individual requirement of a player.

The patent to Sears, U.S. Pat. No. 2,432,450, issued on Dec. 9, 1947, for Golf Club, discloses a metal club head which is recessed to provide a chamber. Within the chamber of the club head is a liquid weight medium. The liquid weight is in the form of mercury.

In the patent to Estes, U.S. Pat. No. 3,516,673, issued on Jun. 23, 1970, for Club With Shifting Weight, there is disclosed a golf club having a hollow head. In the hollow head is a container partially filled with mercury.

The patent to Hull et al., U.S. Pat. No. 5,082,279, issued on Jan. 21, 1992, for Liquid Filled Golf Club, discloses a golf club head having a hollow section. The hollow section of the club head is water-tight and is partially filled with liquid or other flowable material.

The patent to Simmons, U.S. Pat. No. 5,316,300, issued on May 31, 1994, for Golf Club Having Hollow Shaft With Fluid Selectively Installed Therein, discloses a golf club with a hollow shaft. A chamber containing fluid is disposed in a selected section of the shaft. The fluid is of high viscosity.

In the patent to Riley, U.S. Pat. No. 4,139,196, issued on Feb. 13, 1979, for Distance Golf Clubs, there is disclosed a golf club having alignment aids in the form of parallel indicia formed on the top surface of the club head. The parallel indicia are disposed in the direction of the desired line of flight for facilitating the alignment of the club head with the ball.

SUMMARY OF THE INVENTION

An object of the present invention is to provide a golf club in which the club head enables a golfer to putt with improved accuracy and greater distance control.

Another object of the present invention is to provide a golf club in which the club head enables a golfer to have an improved soft touch upon contact between the club head and the golf ball.

Another object of the present invention is to provide a golf club in which the golf club head has face balancing to reduce the incidence of gyrations and vibrations, as well as to reduce torque and turning moment of the club head, at the time of impact between the club head and the golf ball.

DETAILED DESCRIPTION OF THE PREFERRED EMBODIMENTS

Figure 1:
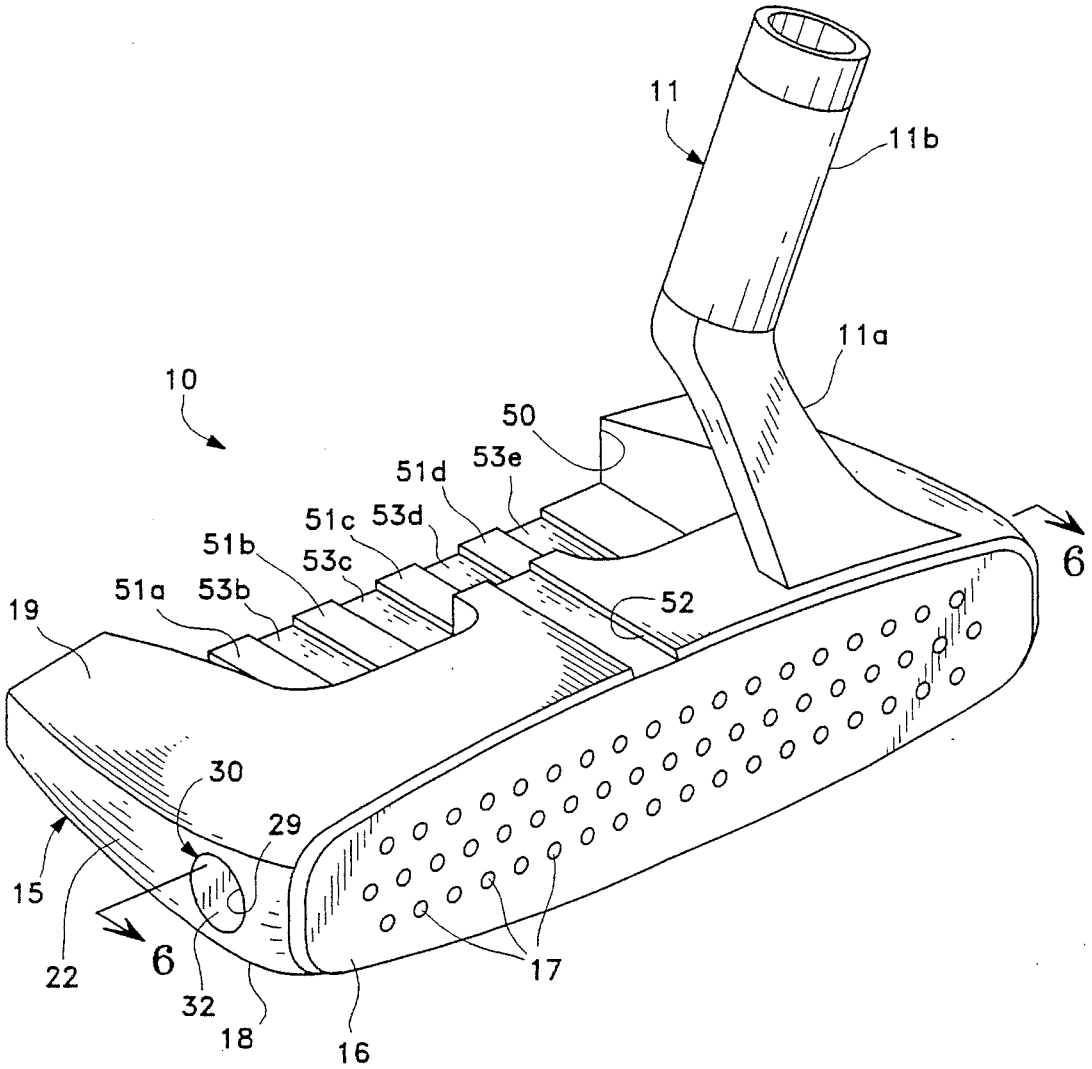
FIG. 1 is a perspective view of a golf club head embodying the present invention as viewed from the face and toe of the club head.

Illustrated in FIGS. 1–8 is a golf club head 10 embodying the present invention, which is suitable for use as the golf club head of a putter. While the golf club head of a putter is disclosed herein, it is to be understood that the present invention is applicable to golf clubs other than a putter. In the preferred embodiment, the golf club 10 comprises a body 15 made of T-6 heat treated aluminum. The club head 10, in the exemplary embodiment, weighs approximately 236 grams. A hosel 11 is integrally formed with the body 15 of the club head 10. In the preferred embodiment, the hosel 11 and the club body 15 are cast as one-piece. The hosel 11 at the upper end 11*b* thereof has an internal diameter of 0.375 of an inch.

The body 15 is formed with a club face 16 suitably indented by indentations 17 to improve the ball striking surface of the club head 10. In the exemplary embodiment, the face 16 of the club head 10 is inwardly directed from the sole 18 of the body 15 to the top wall 19 of the body 15 at a loft angle of three degrees. The top wall 19 of the body 15 curves initially upward in the heel to toe direction and then curves downwardly in the heel to toe direction until it reaches an upright rear wall 20. The sole 18 of the body 15 has a slight arcuate configuration between the heel 21 and the toe 22. The upright dimension of the club face 10, in the exemplary embodiment, is 0.870 of an inch and the top wall 19 of the club face 10 has an upright dimension of one inch at its maximum extent. In the exemplary embodiment, the face 16 of the club head 10 is approximately 2.135 inches between the toe 22 and the heel 21 of the club head 10.

Figure 5:
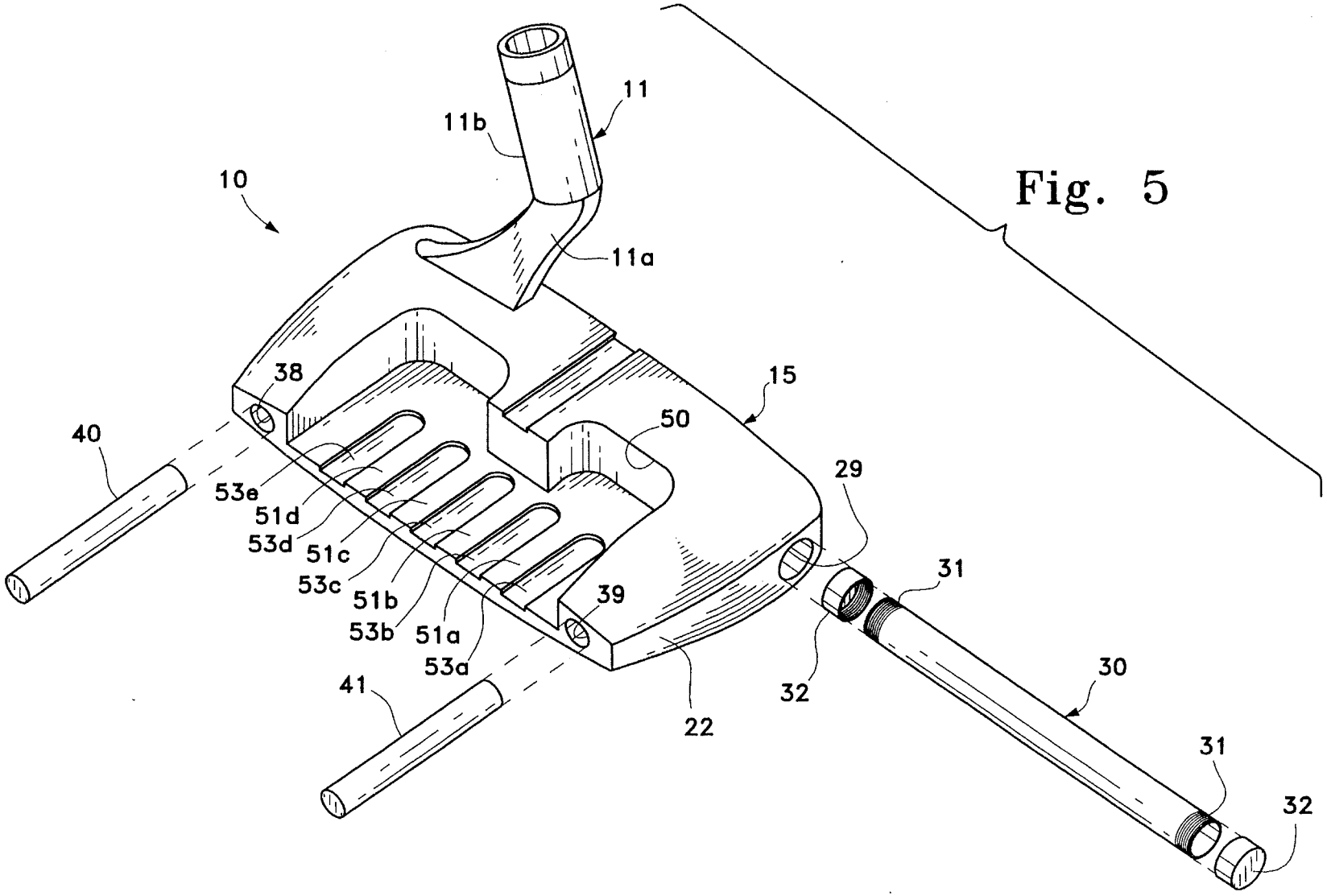
FIG. 5 is an exploded view of the club head shown in FIGS. 1–4 illustrating a weight directed from the toe toward the heel of the club head and weights directed from the rear wall of the club head toward the face of the club head.
Figure 6:
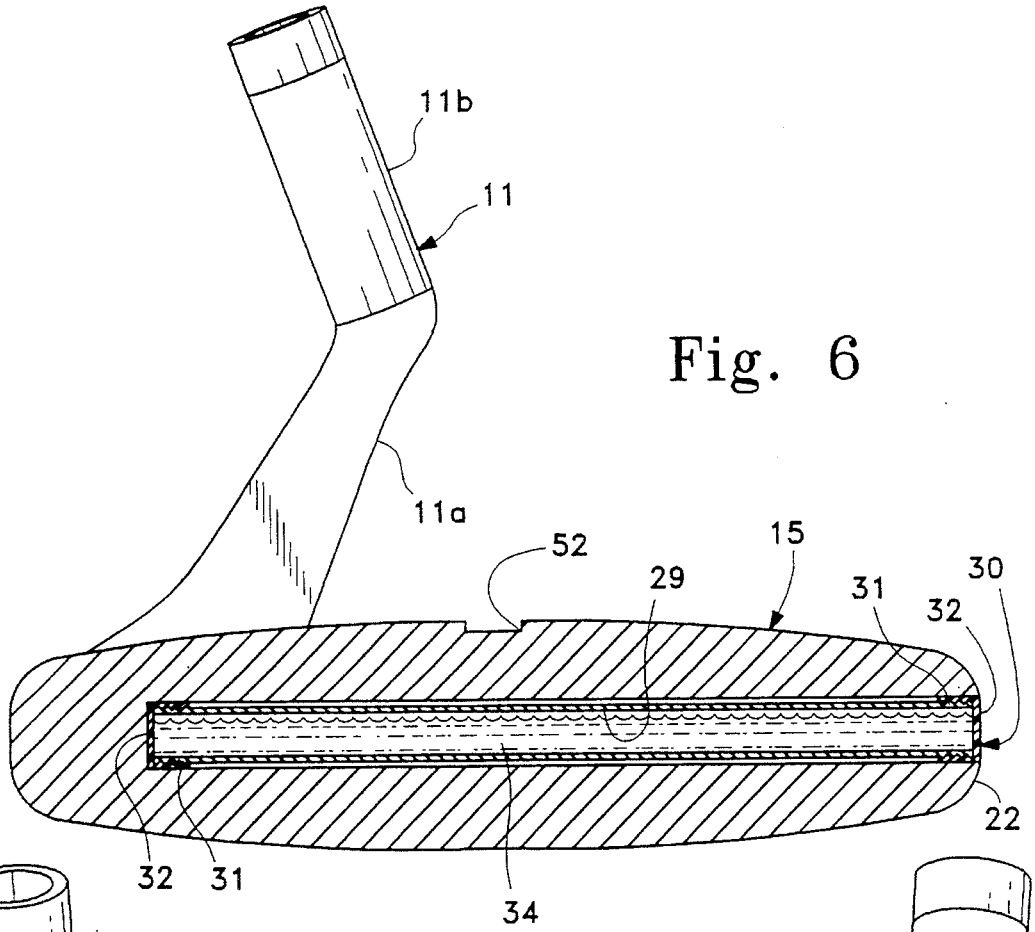
FIG. 6 is a vertical sectional view taken along line 6—6 of FIG. 1 to illustrate the weight directed from the toe toward the heel of the club head.
Figure 8:
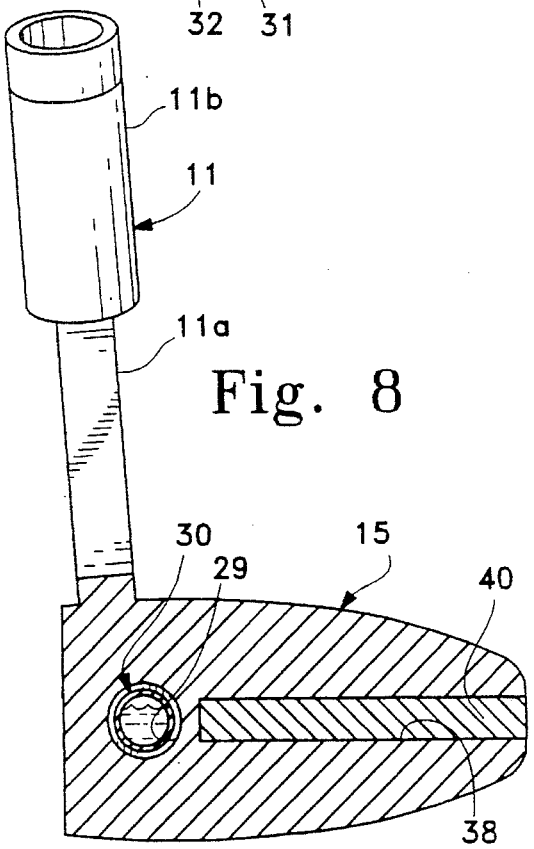
FIG. 8 is a vertical sectional view taken along line 8—8 of FIG. 4 to illustrate the weight at the heel end of the golf club head directed from the rear wall of the club head toward the club face of the club head.
Figure 7:
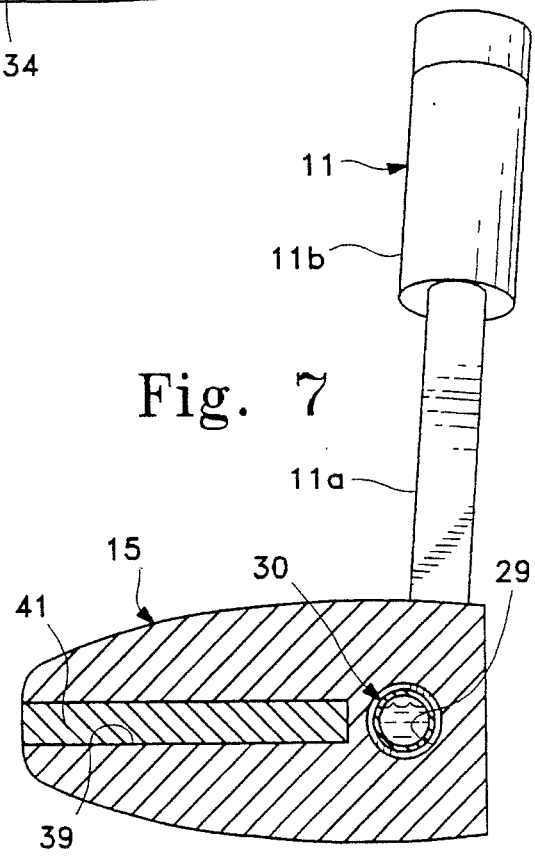
FIG. 7 is a vertical sectional view taken along line 7—7 of FIG. 4 to illustrate the weight at the toe end of the golf club head directed from the rear wall of the club head toward the club face of the club head.
Figure 9:
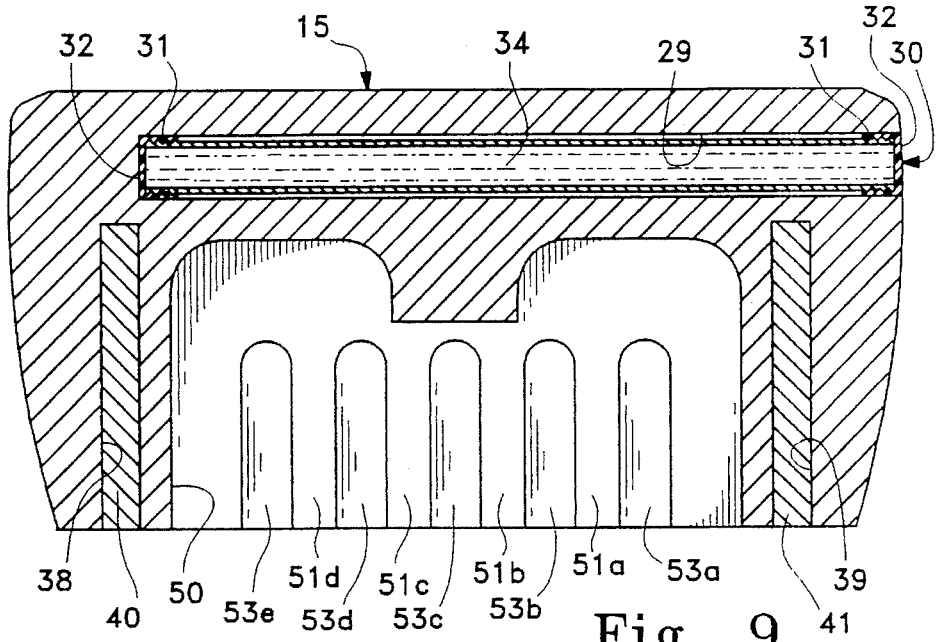
FIG. 9 is a horizontal sectional view taken along line 9—9 of FIG. 3 to illlustrate the weight directed from the toe toward the heel of the club head and to illustrate the parallel weights at the heel end and the toe end of the club head directed from the rear wall of the club head toward the club face of the club head.

Formed in the body 15 is a cylindrical opening 29 that extends in its axial direction from the toe 22 toward the heel 21 of the body 15. The opening 29 is approximately or slightly less than 27/64th of an inch in the exemplary embodiment. A weight 30 is disposed in the opening 29, which weight 30 is in the form of a tube (FIGS. 5, 6 and 9). The outer wall of tubular weight 30 has a close fit with the wall surrounding the opening 29. In the exemplary embodiment, the tubular weight 30 may be made of metal, such as, for example, tungsten, lead, and brass. In the preferred embodiment, the tubular weight 30 is made of lead. In the exemplary embodiment, the tubular weight 30 is filled with a suitable viscous liquid 34, such as oil. The tubular weight 30, in the exemplary embodiment, is spaced 0.220 of an inch from the face 16 of the club head 10. In the exemplary embodiment, the viscous material 34 is of a SAE 90 weight oil.

The tubular weight 30, in the preferred embodiment, has an outside diameter approximately 27/64th of an inch. Each end of the tubular weight 30 has internal threads 31. At each end of the tubular weight 30 is a leak proof cap 32, each of which has external threads 33. The leak proof caps 32, in the exemplary embodiment, are made of suitable material, such as plastic, rubber or neoprene. On each end of the tubular weight 30, in the preferred embodiment, is a suitable O-ring or washer confronting the enlarged diameter section of the associated leak proof cap 32. The caps 32 are disposed in threaded engagement with the threaded ends 31 of the tubular weight 30 to contain the liquid in the tubular weight 30. In the preferred embodiment, a suitable epoxy causes the caps 32 to adhere to the ends of the tubular weight 30.

Formed in the body 15 are parallel, cylindrical openings 38 and 39 (FIGS. 5 and 9) extending from the rear wall 20 toward the club face 16 of the club head 10. Disposed within the openings 38 and 39 are solid, cylindrical weights 40 and 41, respectively, which are made of suitable material, such as lead, brass, and tungsten. The solid weights 40 and 41 are disposed in parallel relation and the axes thereof are disposed at right angles to the axis of the tubular weight 30. The solid weights 40 and 41 form a tight fit with the walls surrounding the cylindrical openings 38 and 39 and may be wedged therein. In the preferred embodiment, a suitable epoxy causes the solid weights 40 and 41 to adhere securely to the walls surrounding the cylindrical openings 38 and 39. The weight of the solid weights 40 and 41 and the metallic material for the solid weights 40 and 41 may vary depending on the requirements of the user of the club head 10.

By virtue of the tubular weight 30 and the solid weights 40 and 41, the club head 10 provides face balancing to reduce the incidence of gyration and reduces vibrations. As a consequence, the club head 10 enables the golf club to have a soft touch upon contact with the golf ball. The tubular weight 30 and the solid weights 40 and 41 enables the club head 10 to improve torque resistance as the club head 10 has impact with the golf ball. The tubular weight 30 provides a wide sweet spot for the face 16 of the club head 10.

The hosel 11, which is made of suitable material, such as stainless steel, is located at the heel end 21 of the club head 10. The lower end **11*a* of the hosel 11 is solid and is angularly and upwardly disposed toward the toe 22 of the club head 10 relative to the top wall 19. The upper end 11*b* of the hosel 11 is integrally formed with the lower end 11*a* of the hosel 11 and is disposed upwardly and angularly relative to the lower end 11*a* of the hosel 11 toward the heel end 21 of the club head 10. The upper end 11*b* of the hosel 11 is tubular to receive the lower end of the club shaft in a manner to be described hereinafter. In the exemplary embodiment, the upper end 11*b* of the hosel 11 is at an angle of four and one-half degrees from the perpendicular of the top wall 19**.

Figure 2:
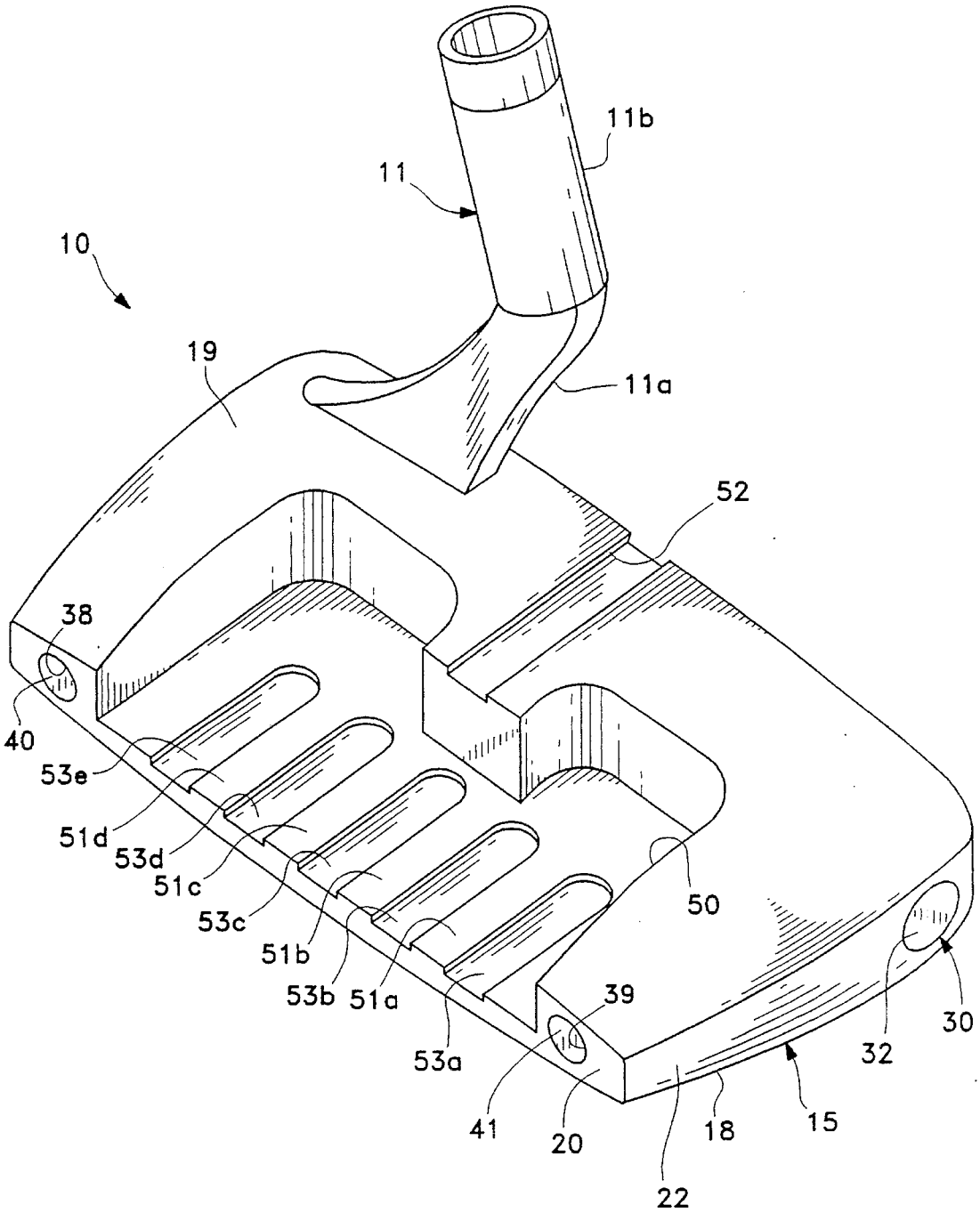
FIG. 2 is a rear perspective view of the golf club head shown in FIG. 1 as viewed from the top wall of the club head and the toe of the club head.
Figure 3:
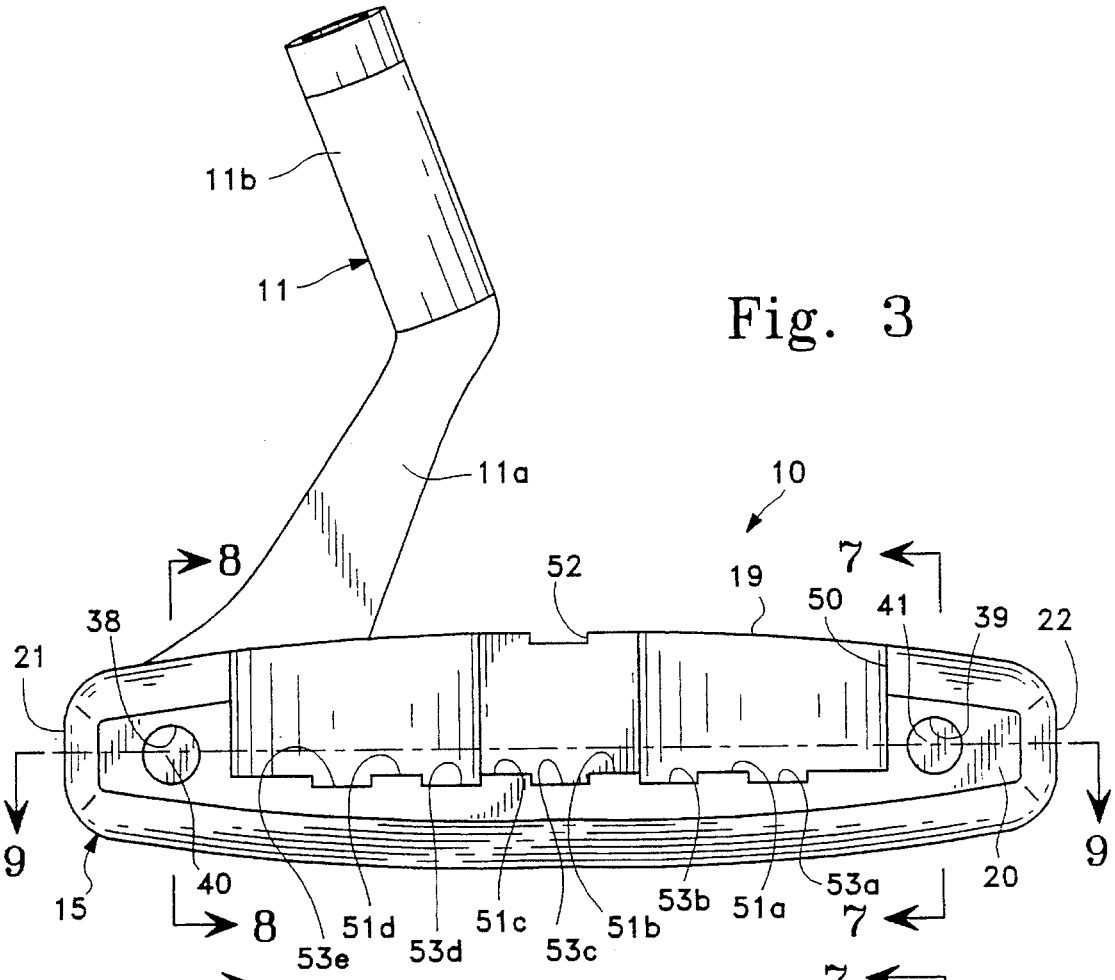
FIG. 3 is a rear elevation of the club head shown in FIGS. 1 and 2.
Figure 4:
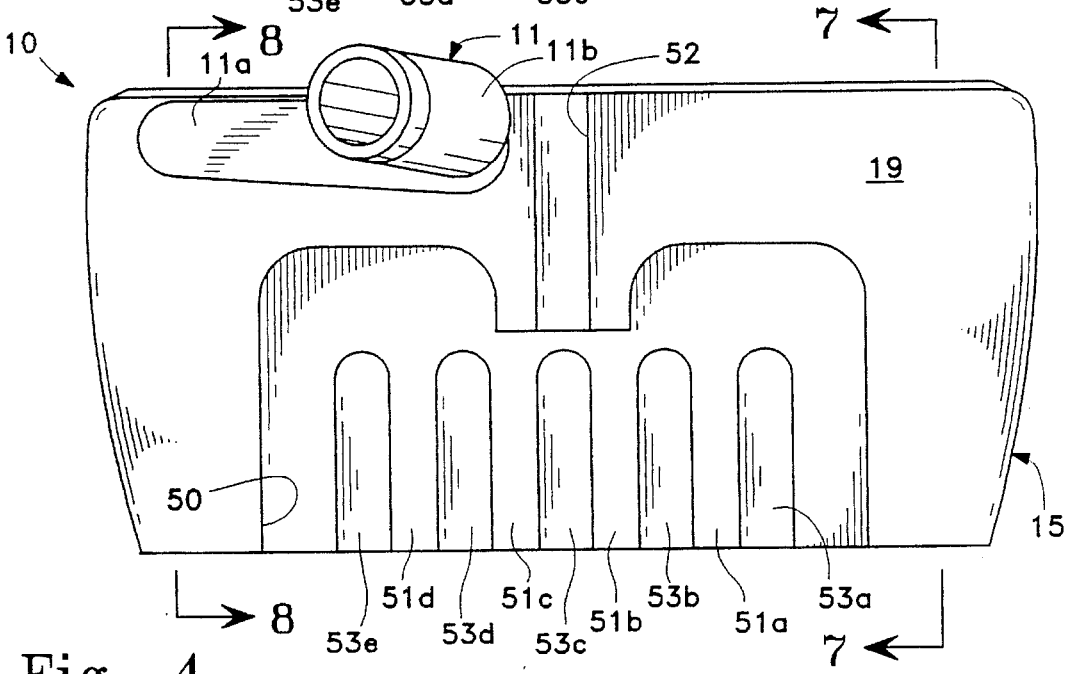
FIG. 4 is a plan view of the club head shown in FIGS. 1–3.

The body 15 of the club head 10 is recessed at 50 relative to the top wall 19 (FIGS. 1 and 2). Disposed within the recess 50 of the body 15 are successive, parallel, rectangular ridges **51*a*–51*d*, which extend from the rear wall 20 toward the face 16 of the club head 10. Formed on the top wall 19 of the club head 10 is a rectangular groove 52 that is parallel to the rectangular grooves 53*a*–53*e*. The rectangular groove 52 is parallel to the rectangular grooves 53*a*–53*e* and extends from the club face 16 toward the rear wall 20. The groove 52 is aligned with the groove 53*c*. The grooves 53*a*–53*e* are, respectively, 0.250 of an inch wide, 0.920 of an inch long, and 0.050 of an inch deep. The groove 52 and the grooves 53*a*–53*e*** provide visual aid for the alignment of the direction of movement of the golf ball to aid in addressing the golf ball.

Figure 10:
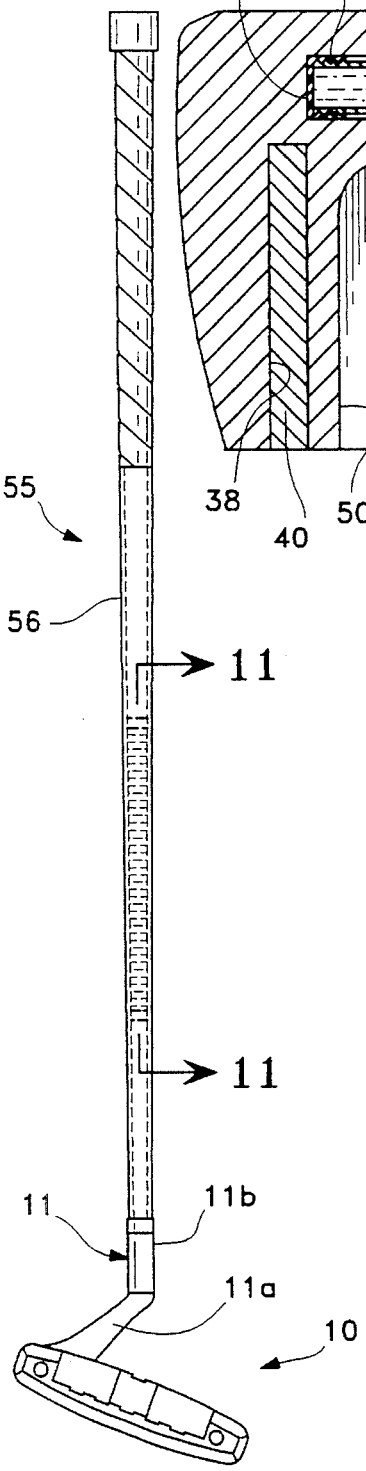
FIG. 10 is an elevational view of a golf club embodying the present invention.
Figure 11:
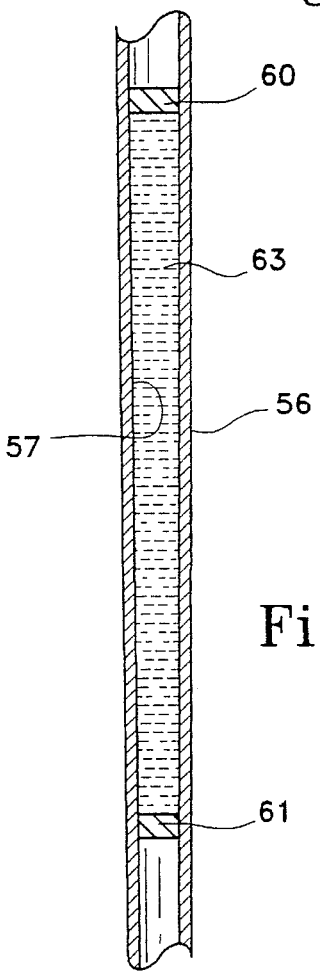
FIG. 11 is a vertical elevational view taken along line 11—11 of FIG. 10 to illustrate a hollow shaft having a chamber containing a high viscosity fluid disposed in a section of the hollow shaft.

Illustrated in FIGS. 10 and 11 is a golf club 55 embodying the present invention. The golf club 55 comprises a tubular or hollow shaft 56, the hosel 11, and the club head 10. The club shaft 56 is fully described in the patent to Simmons, U.S. Pat. No. 5,316,300 issued on May 31, 1994, for Golf Club Having Hollow Shaft With Fluid Selectively Installed Therein. The lower end of the shaft 56 is received in fixed relation in a conventional manner to the upper end **11*b* of the hosel 11**.

The tubular shaft 56 comprises a chamber 57. Suitable plugs 60 and 61 define the upper and lower limits of the chamber 57. The chamber 57 is filled with a suitable fluid 63. In the preferred embodiment, the fluid 63 is of a high viscosity, i.e. a viscosity of 250,000–350,000 centipoises at 5 r.p.m. and 76 degrees fahrenheit. The fluid 63 should not flow readily and, thus, gives the shaft 55 solidity. A suitable fluid is latex calk type M8969 sold by Macklanbury-Duncan Co. of Oklahoma City, Okla. The shaft 56 may be made of a metal or plastic material, such as, for example, titanium, steel, graphite, boron, aluminum or Kevlar. The length of the chamber 57 should constitute 10%–80% of the total length of the shaft 56. In the preferred embodiment, the chamber 57 constitutes 20%–30% of the total shaft length.

The choice of the length of the chamber 57 is dictated by various considerations, such as the flex pattern of the material and the characteristics of the fluid employed. The positioning of the chamber 57 along the length of the shaft 56 affects the natural vibration frequency of the shaft 56. The closer the chamber 57 is disposed to the club head 10 provides lower natural vibration frequencies. Conversely, the greater the distance between the chamber 57 and the club head 10 provides higher natural vibration frequencies. Thus, by selecting the positioning of the chamber 57 relative to the club head 10, the natural vibration frequency can be adjusted as may be desired. The placement of the chamber 57 containing the high viscous fluid at selected predetermined locations minimizes the deformation of the shaft 56 under load and controls the natural vibration frequency of the shaft 56.

The shaft 57 and the club head 10 coact to improve the face balancing of the golf club 55, thereby assisting the golfer in improving the golf skills by enabling more accurate directing of the golf ball and by enabling improved control over the distance in which the golf ball travels.

Figure 12:
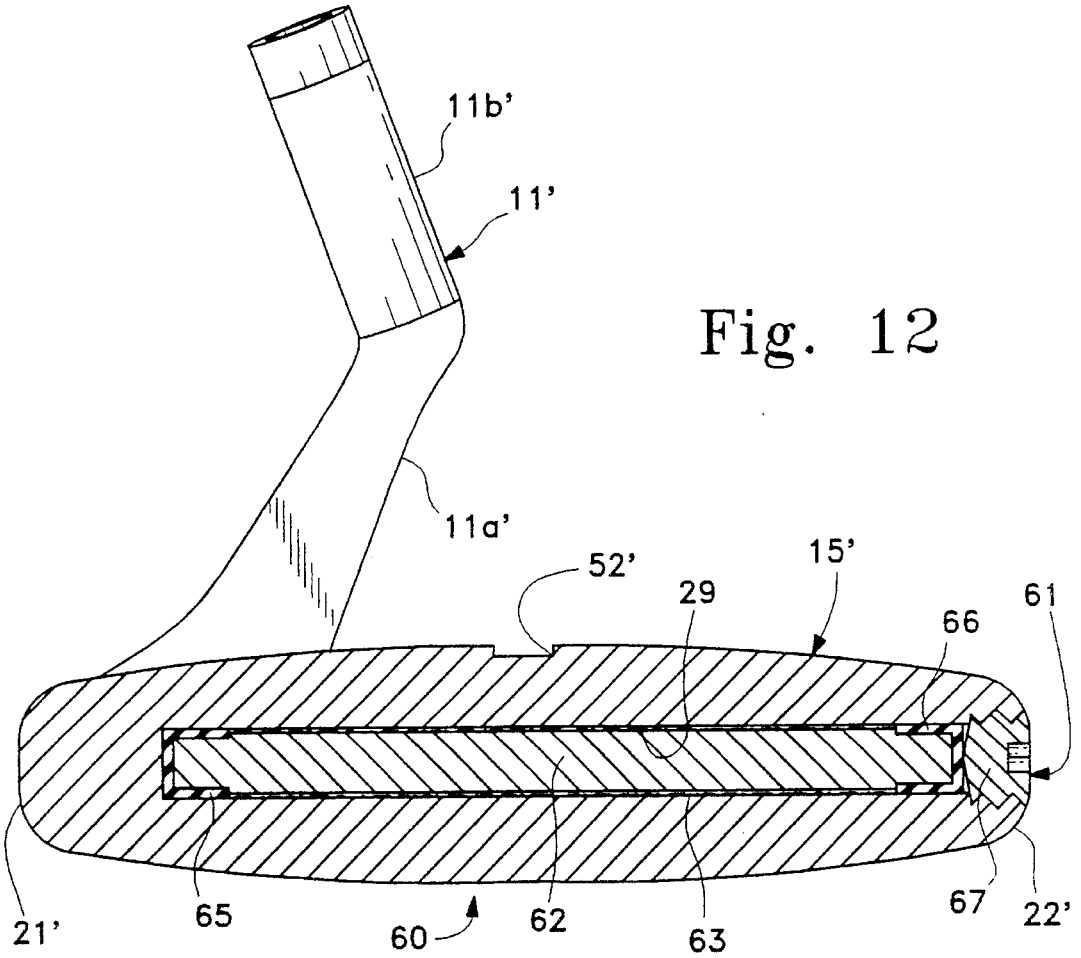
FIG. 12 is a vertical sectional view of another embodiment of a club head incorporating the present invention and illustrating a modified weight directed from the toe toward the heel of the club head and taken along line 6—6 of FIG. 1.
Figure 13:
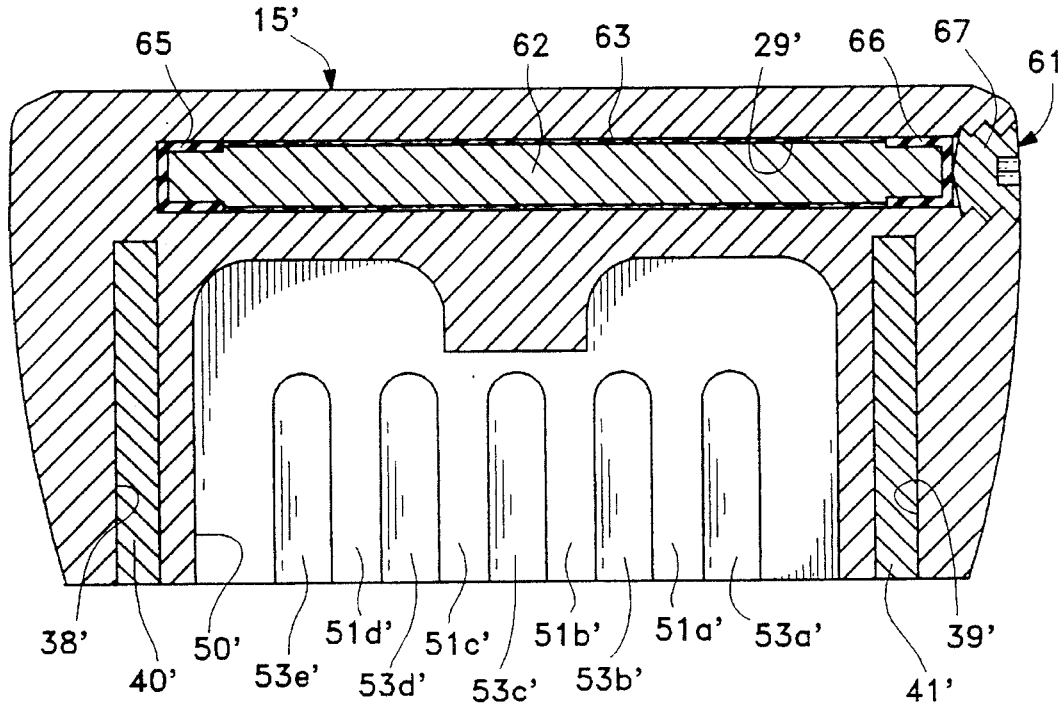
FIG. 13 is a horizontal sectional view of the club head shown in FIG. 12 to illustrate the modified weight directed from the toe toward the heel of the club head shown in FIG. 12 and taken along line 9—9 of FIG. 3.

Illustrated in FIGS. 12 and 13 is another embodiment of a club head incorporating the present invention. As shown in FIGS. 12 and 13, a club head 60 comprises a modified weight 61 that extends between the toe and the heel of the club head 60. Parts of the club head 60 similar to the club head 10 have been designated with the same reference numeral but with a prime suffix.

The club head 60 is similar to the club head 10 except that the weight 61 is employed in lieu of the tubular weight 30. The weight 61 comprises a solid cylindrical member 62 made of a suitable metal, such as tungsten, lead or brass. The solid cylindrical member 62 is disposed in a cylindrical opening 29' formed in a body 15' of the club head 60 and extends from a toe 22' toward a heel 21' of the body 15'. In the exemplary embodiment, the cylindrical opening 29' contains a suitable viscous material 63, such as oil. The diameter of the cylindrical member 62 is slightly less than the diameter of the cylindrical opening 29' so that the cylindrical member 62 is surrounded by the viscous material 63, when the cylindrical member 62 is disposed in the cylindrical opening 29'. In the exemplary embodiment, the viscous material 63 is of a SAE 90 weight oil.

At the ends of the cylindrical member 62 are soft rubber caps 65 and 66, respectively, made of suitable material, such as silicon rubber. The caps 65 and 66 are caused to adhere to the ends of the cylindrical member 62, respectively, by a suitable epoxy and have a respective diameter substantially equal to the diameter of the opening 29'. By virtue of the solid, cylindrical member 62, the viscous material 63 surrounding the solid, cylindrical member 62 and the soft rubber caps 65 and 66, the impact moment between the club head 60 and a golf ball is prolonged or has an extended dwell time. The caps 65 and 66 are caused to adhere to the ends of the cylindrical member 62 by a suitable epoxy. The cap 66 serves as a seal to retain the viscous material within the opening 29'. A threaded plug 67 is disposed in threaded engagement with the threaded wall surrounding the opening 29' to retain the weight 60 within the opening 29 and to seal the viscous material 63 within the opening 29' along with the cap 66.

The club head 60 can be used with the golf club 55 in the manner described for the golf head 10.

It is within the contemplation of the present invention that the viscous material 63 can be omitted. In which event, the soft rubber caps 65 and 66 will serve to prolong or extend the dwell time of the impact moment between the club head 60 and a golf ball.

What is claimed is:

1. A golf club head comprising:

(a) a body having a club face, a toe, and a heel, said body being formed with an elongated opening extending lengthwise between the toe and the heel of said body;

(b) an elongated first weight received by said opening in said body and extending lengthwise intermediate the toe and the heel of said body adjacent to said club face, (c) said body including a rear wall; and (d) a plurality of second elongated weights extending lengthwise intermediate said rear wall and said club face of said body.

2. A golf club head as claimed in claim 1 wherein said second weights are disposed in spaced parallel relation at right angles to said first weight.

3. A golf club head as claimed in claim 2 wherein one of said second weights is disposed adjacent the toe of said body and another of said second weights is disposed adjacent the heel of said body.

4. A golf club head as claimed in claim 1 wherein said second weights extend from said rear wall toward said first weight adjacent to said first weight.

5. A golf club head comprising:

(a) a body having a club face, a toe, and a heel;

(b) a first weight extending intermediate the toe and the heel of said body adjacent to said club face, said first weight comprising an enclosed tube axially disposed between the toe and the heel of said body:

(c) a viscous liquid contained within said tube, (d) said body including a rear wall; and (e) a plurality of solid second weights, said second weights being disposed in spaced parallel relation and at right angles to said first weight, one of said second weights being disposed adjacent to the toe of said body and another of said second weights being disposed adjacent the heel of said body, said second weights extending from said rear wall toward said club face adjacent said first weight.

6. A golf club head comprising:

(a) a body having a club face, a toe, and a heel;

(b) a first weight extending intermediate the toe and the heel of said body adjacent to said club face; said first weight extending from the toe of said body toward the heel of said body and adjacent to the heel of said body, said first weight comprising an enclosed tube axially disposed between the toe and the heel of said body;

(c) a viscous liquid contained within said tube, (d) said body including a rear wall; and (e) a plurality of solid second weights, one of said second weights being disposed adjacent to the toe of said body and another of said second weights being disposed adjacent the heel of said body, said second weights extending from said rear wall toward said club face adjacent said first weight.

7. A golf club head comprising:

(a) a body having a club face, a toe and a heel; and (b) a first weight extending intermediate the toe and the heel of said body adjacent to said club face, (c) said body being formed with an opening extending between the toe and the heel of said body, (d) said first weight being disposed in said opening and extending between the toe and the heel of said body, said first weight comprising a viscous liquid disposed in said opening and a solid member disposed in said opening and surrounded by said viscous liquid.

8. A golf club head as claimed in claim 7 wherein said solid member has oppositely directed ends, said first weight comprising rubber caps secured to said oppositely directed ends respectively of said solid member for extending the dwell time of impact between a golf ball and said club head.

9. A golf club head comprising:

(a) a body having a club face, a toe, and a heel;

(b) a first weight extending intermediate the toe and the heel of said body adjacent to said club face;

(c) said body including a rear wall; and (d) a plurality of second weights extending intermediate said rear wall and said club face of said body, (e) said body being formed with an opening extending between the toe and the heel of said body, (f) said first weight being disposed in said opening and extending between the toe and the heel of said body, (g) said first weight comprising a viscous liquid disposed in said opening and a solid member disposed in said opening and surrounded by said viscous liquid.

10. A golf club head as claimed in claim 9 wherein said solid cylindrical member has oppositely directed ends, said first weight rubber caps secured to said ends respectively of said solid cylindrical member for extending the dwell time of impact of a golf ball with said club head.

11. A golf club head comprising:

(a) a body having a club face, a toe, and a heel;

(b) a weight extending intermediate the toe and the heel of said body adjacent to said club face, (c) said body being formed with an opening extending between the toe and the heel of said body, (d) said weight comprising a solid member disposed in said opening, said solid member having oppositely directed ends, said weight comprising rubber caps secured to said oppositely directed ends respectively of said solid member for extending the dwell time of impact between a golf ball and said club head.

12. A golf club comprising:

A. a golf club head, said golf club head comprising:

(a) a body having a club face, a rear wall, a toe, and a heel, (b) a first weight extending from the toe of said body toward the heel of said body and adjacent to the heel of said body, and (c) a plurality of said second weights disposed in spaced parallel relation and at right angles to said first weight, one of said second weights being disposed adjacent to the toe of said body and another of said second weights being disposed adjacent the heel of said body, said second weights extending from said rear wall toward said club face adjacent said first weight;

B. a hosel integrally formed with said body adjacent the heel of said body; and

C. a tubular shaft received at the lower end thereof by said hosel in fixed relation, said shaft comprising:

(a) enclosure elements disposed within said tubular shaft forming a fluid tight chamber, said chamber being disposed intermediate the ends of said tubular shaft, and (b) a viscous fluid disposed within said chamber to reduce deformation of said shaft under load and to control the natural vibration frequency of said shaft.

* * * * *